United States Patent [19]

Burns et al.

[11] 4,322,587

[45] Mar. 30, 1982

[54] KEYBOARD DEVICE

[75] Inventors: Jack L. Burns, Gilbert, Ariz.; Link Forte, Xenia, Ohio

[73] Assignee: Rogers Corporation, Rogers, Conn.

[21] Appl. No.: 100,861

[22] Filed: Dec. 6, 1979

[51] Int. Cl.[3] ..... H01H 9/26

[52] U.S. Cl. ..... 200/5 R; 200/159 B; 200/302; 200/340

[58] Field of Search ..... 200/1 R, 5 R, 5 A, 159 B, 200/275, 302, 329, 340

[56] References Cited

U.S. PATENT DOCUMENTS

| | | | |
|---|---|---|---|
| 3,723,673 | 3/1973 | Clary et al. | 200/5 A X |
| 3,860,771 | 1/1975 | Lynn et al. | 200/5 R X |
| 4,046,975 | 9/1977 | Seeger, Jr. | 200/159 B X |
| 4,066,850 | 1/1978 | Heys, Jr. | 200/159 B X |
| 4,127,752 | 11/1978 | Lowthorp | 200/5 A |
| 4,237,351 | 12/1980 | Boulanger et al. | 200/5 A |

*Primary Examiner*—Richard L. Moses

*Attorney, Agent, or Firm*—Fishman and Van Kirk

[57] ABSTRACT

A keyboard has a planar surface with depressions formed therein. Switch devices of the type which provide tactile feedback are aligned with the depressions. Exertion of downward force on the base of the depressions will cause switch contacts to be closed with a snap-action to generate an information bearing signal.

16 Claims, 7 Drawing Figures

KEYBOARD DEVICE

BACKGROUND OF THE INVENTION (1) Field of the Invention

The present invention relates to facilitating the entry of data into data processing apparatus by means of a keyboard. More particularly, the present invention relates to a keyboard including keys having a depressed or concave shape to allow for non-visual perception of the key, that is, perception of the key by touch. Accordingly, the general objects of the present invention are to provide novel and improved methods and apparatus of such character.

(2) Description of the Prior Art

A conventional keyboard includes an array of keys which may be individually actuated to close a pair of contacts of an electrical circuit associated with each of the keys. It is often considered desirable to provide for tactile feedback so that, when the keys are pressed by the finger of a person operating the keyboard, the keys "snap" and force discontinuity is transmitted to the finger of the user indicating that the key has been actuated and an electrical signal thus generated in the circuit associated with the key. A conventional prior art keyboard may include a flat flexible legend sheet which defines a plurality of points or areas on the sheet which the operator of a keyboard may press to actuate a snap-action element associated with the particular point or area. Typically, the points or areas on the legend sheet are indicated in some visual manner, that is, the legend sheet may have printed thereon a legend indicating the function of the key positioned beneath the legend sheet. For example, the legend sheet may include a series of numbers, letters or symbols such as those on a typewriter, or calculator or data terminal keyboard, or, the legend may indicate the particular item to be purchased at a retail outlet.

One problem with prior art keyboards having flat legend sheets is that the area or point to be actuated on the legend sheet must be visually located. Once the particular point or area on the keyboard is visually located, the person using the keyboard must position his finger or some other object directly in contact with the point or area and press downwardly to actuate a particular key. The accuracy of the data entered by means of the keyboard, accordingly, is a function of operator attentiveness. If the keys are pressed at points removed from the center of the key, the electrical circuit contacts operated by the key may be closed without providing tactile feedback or the key may provide tactile feedback without contact being made.

It is an object of the present invention to provide a keyboard wherein the keys may be located by an operator in a non-visual manner, that is, the keys may be perceived by touch in addition to being perceived visually.

SUMMARY OF THE INVENTION

The present invention overcomes the above-discussed and other disadvantages of the prior art by providing a keyboard and component parts thereof wherein the location of actuators for contacts of electrical switches may be perceived by touch. In accordance with the preferred embodiment of the invention the keyboard includes a snap-action element of the type which provides tactile feedback when operated. The invention further includes a continuous flexible legend sheet which has a plurality of depressions or concavities which are perceptible by touch and serve as key locators. The continuous flexible legend sheet provides the benefits of moisture and dust exclusion found with prior art flat legend sheets and also provides the advantage of being perceptible by touch. The legend sheet will typically include numbers, symbols or other graphic indicia thereon. The legend sheet can also serve as a cosmetic element, that is, graphics may be printed on the legend sheet to provide an aesthetically pleasing legend sheet.

A legend sheet including integral depressions in accordance with the present invention is capable of use with various types of snap-acting switch actuators which provide tactile feedback when operated.

BRIEF DESCRIPTION OF THE DRAWINGS

The present invention may be better understood and its numerous objects and advantages will be apparent to those skilled in the art by reference to the accompanying drawings wherein like reference numerals refer to like elements in the several FIGURES and in which.

DETAILED DESCRIPTION OF THE INVENTION

Figure 1:
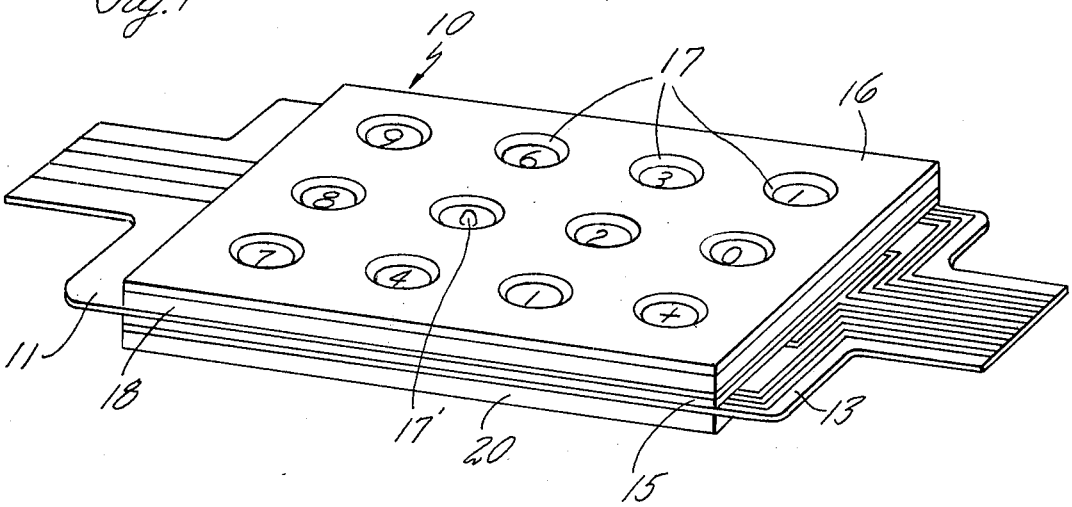
FIG. 1 is a perspective view of a portion of a keyboard incorporating a preferred embodiment of the present invention.
Figure 3:
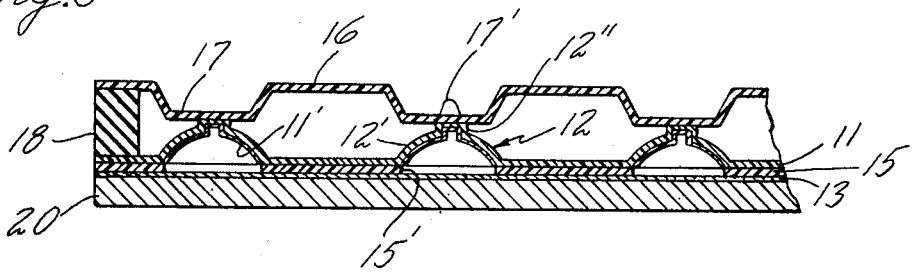
FIG. 3 shows a cross-sectional view along line 3—3 of FIG. 1.
Figure 2:
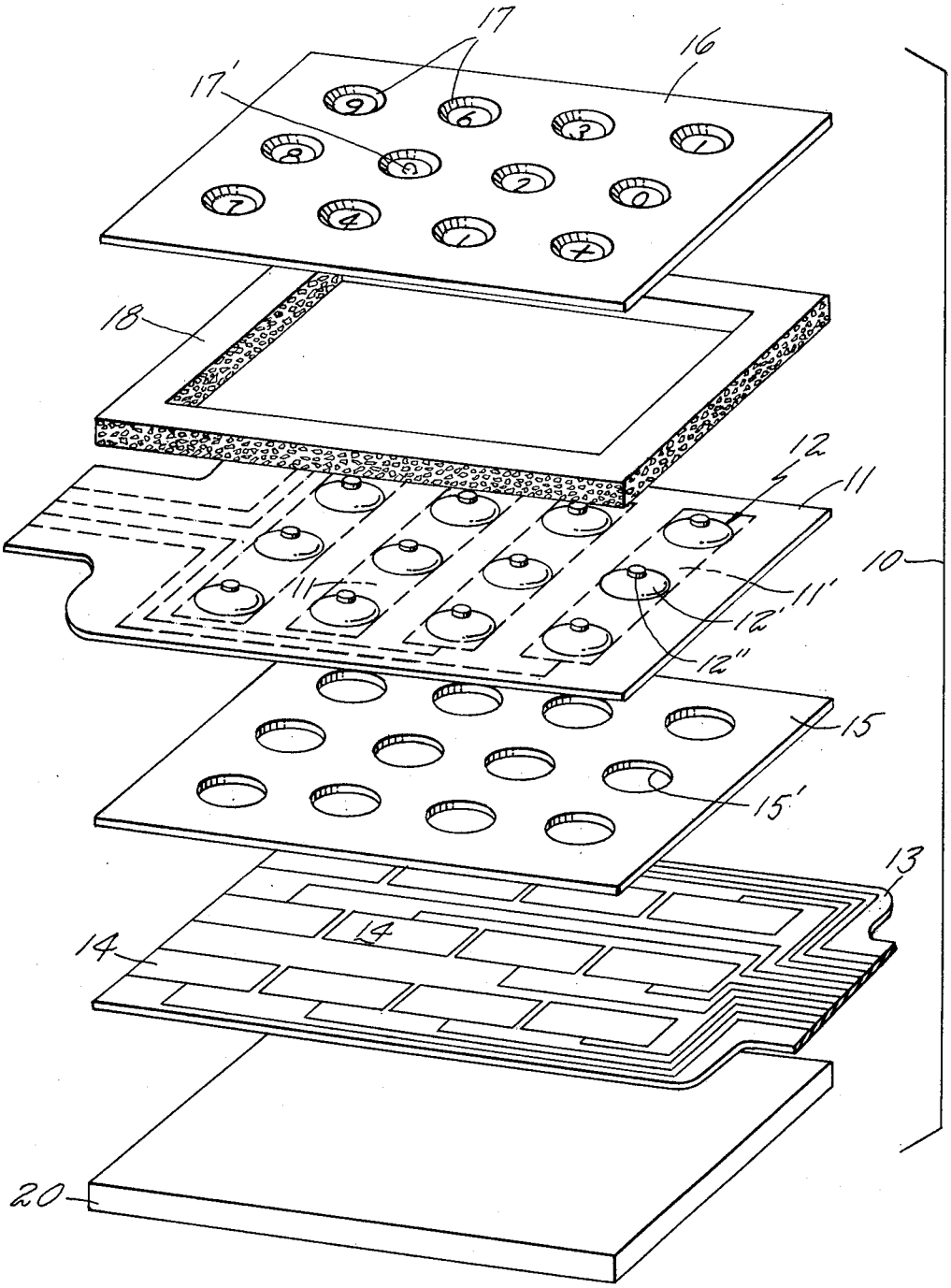
FIG. 2 is an exploded view of the components of the keyboard shown in FIG. 1.

Referring to FIGS. 1 and 2 and 3 simultaneously, a keyboard indicated generally at 10 includes a first thin (0.005 to 0.010) flexible sheet 11 including a plurality of integral protrusions 12 formed therein. Sheet 11 is a plastic material, such as the Polyethylene Terpthalate known as Mylar. The protrusions 12 function as snap-action tactile elements. Conductive paths, such as copper, conductive ink or other conductive materials, are formed on and are bonded to the underside of sheet 11 by conventional printed circuit techniques and extend into and follow at least part of the contour of each protrusions 12. Thus, in FIG. 2, a plurality of parallel "row" conductors 11' extend into protrusions 12 and may cover all or part of the under surface thereof. The keyboard 10 further includes a second (0.005–0.010") flexible sheet 13 of Mylar or other plastic which carries printed circuitry in the form of parallel "column" conductors 14 on the top thereof. The first flexible plastic sheet 11 is spaced from the second plastic flexible sheet 13 by a third thin (0.005–0.010") sheet 15 of plastic (e.g. Mylar) or other non-conductive separator material. Sheet 15 is provided with a plurality of die-cut apertures 15'. Sheet 15 may be adhesively bonded to sheets 11 and 13.

Each snap-action tactile element 12 includes a generally hemispherical invertible dome 12' and, extending from the top thereof, an actuator element 12''. Each actuator element 12'' will also be integral with sheet 11, and will preferably be in the form of a cylinder with a flat end cap. Actuators 12'' are non-invertible. Restated, because of their size and shape, the cylindrical extensions 12'' of domes 12' resist inversion under normal loading. For a more detailed disclosure of the snap-action tactile elements 12 with the non-invertible actuator elements 12'', reference is hereby made to United States patent application Ser. No. 961,628 assigned to Rogers Corporation, the assignee of this invention.

The conductive paths 11' on sheet 11 may cover all or a portion of the surface of element 12 which face sheet 13. When a dome 12' is inverted, in the manner to be described below, the wall thereof flexes and moves through an aperture 15' in sheet 15 and electrical contact is thus established between an individual "row" conductor 11' on sheet 11 and a "column" conductor 14 on sheet 13. Conductors 14 are shown in parallel columns only for purposes of illustration; however, as will be understood by those skilled in the art, the columns 14 on sheet 13 may be arranged in any desired circuit pattern depending on the function to be performed.

Keyboard 10 further includes a flexible legend sheet 16 having a plurality of concave depressions 17 therein. Depressions 17 are integral with sheet 16 and allow the user of keyboard 10 to perceive the location of associated keys by touch. Depressions 17 are thus aligned with tactile snap-action elements 12, and each depression 17 is in physical contact with an actuator 12' on top of snap-action element 12. When sheet 16 is urged downwardly, e.g. by force from a finger or other actuator inserted in a depression 17, the dome 12' aligned with the depression inverts causing a circuit to be completed between circuitry on sheets 11 and 13 whereby an information bearing electrical signal is generated. In addition to being perceptible by touch, depressions 17 may have a legend printed therein or adjacent thereto to provide visual indications of the area to be pressed by the person using the keyboard. One of the depressions 17 (for example the "5" key location on a standard calculator format) may also have a protrusion 17' so that the user can locate that key by touch. Legend sheet 16 is spaced from sheet 11 by a peripheral sheet of resilient cellular foam material 18. Sheet 18 is preferably made from a foam material of the type having a low compression set. By low compression set, it is meant that after repeated compression and expansion, the material essentially maintains its dimensions. An example of such material is PORON foam obtainable from Rogers Corporation, the assignee of this invention. The edges of legend sheet 16 may be adhered to foam sheet 18 by a conventional adhesive. Once keyboard 10 is formed, the keyboard is placed on a base 20. Base 20 may, for example, represent a surface of a cash register with which the keyboard may be used; or base 20 may be an integral part of the keyboard 10 and may be sold with the keyboard.

The operation of keyboard 10 will now be described. A person using the keyboard places his finger in a depression 17 and presses downwardly. The underside of the depression 17 contacts an actuator 12'' of a tactile element 12 to impose a load on the associated snap-action element 12 downwardly toward base 20. This load on the snap-action element 12 causes element 12 to move downwardly with snap-action wherein hemispherical dome portion 12' inverts whereupon the circuitry 11' makes electrical contact with the circuitry 14 on sheet 13. When finger pressure on the depression 17 is released, the above described components return to their original position and contact is broken between circuitry 11' and circuitry 14.

Figure 4:
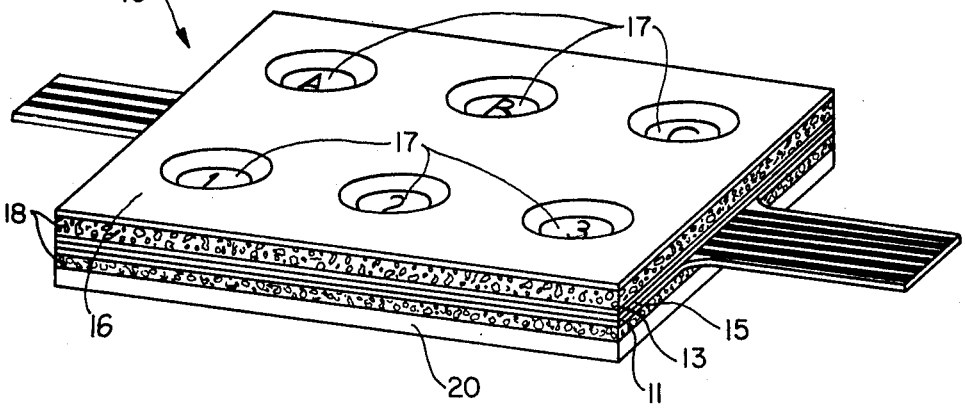
FIG. 4 is a perspective view of a portion of a keyboard incorporating a second embodiment of the present invention.
Figure 5:
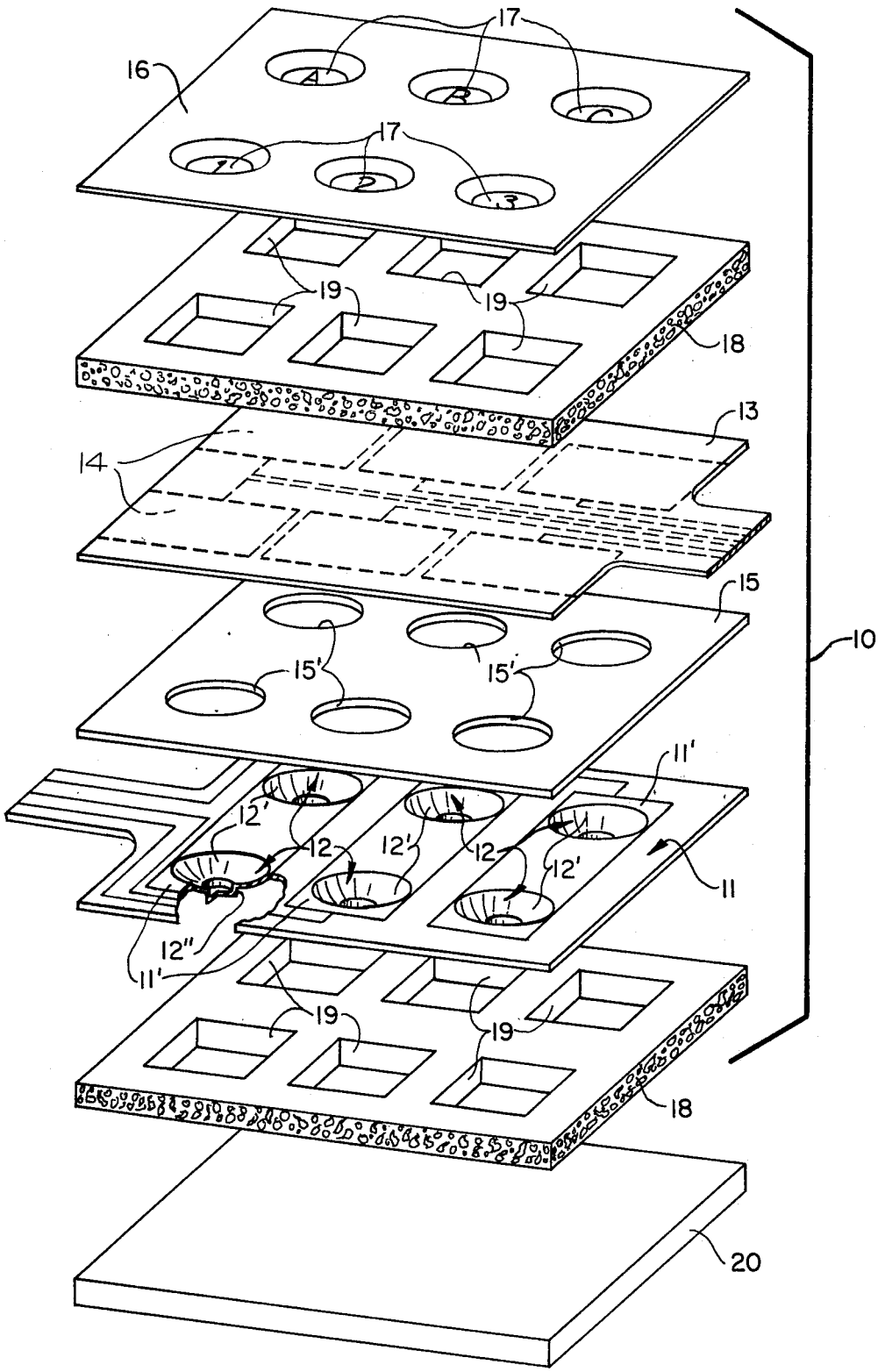
FIG. 5 is an exploded view of the components of the keyboard shown in FIG. 4.

Referring to FIGS. 4 and 5 simultaneously, another embodiment of a keyboard is indicated generally at 10 wherein the sheets 11 and 13 are reversed. The keyboard of FIGS. 4 and 5 includes a first thin (0.005–0.010'') flexible sheet 11 including a plurality of integral reverse protrusions or depressions 12. The depressions 12 function as snap-action tactile elements. Conductive paths, such as copper, conductive ink or other conductive materials, are formed on and are bonded to the upper side of sheet 11 by conventional printed circuit and/or silk screening techniques and extend into and follow at least part of the contours of each protrusion 12 to form first switch contact carried by each of depressions 12. Thus, in FIG. 5 a plurality of parallel "row" conductors 11' extend into depressions 12 and may cover all or part of the upper surface thereof. The keyboard 10 further includes a second (0.005–0.010'') flexible sheet 13 of Mylar or other plastic which in the disclosed embodiment, carries printed circuitry in the form of parallel "column" conductors 14 on the bottom thereof. The first flexible plastic sheet 11 is spaced from the second plastic flexible sheet 13 by a third thin (0.005–0.010) sheet 15 of plastic (e.g. Mylar) or other non-conductive separator material. Sheet 15 is provided with a plurality of die-cut apertures 15'. Sheet 15 may be adhesively bonded to sheets 11 and 13.

Each snap-action tactile element 12 of the FIGS. 4 and 5 embodiment includes a generally hemisphered invertible reverse dome 12' and, extending from the bottom thereof, an actuator element 12'', one of which is shown cut away in FIG. 5. Each actuator element 12'' will also be integral with sheet 11, and will preferably be formed of a cylinder with a flat end cap. Actuators 12'' are non-invertible. Restated, because of their size and shape, the cylindrical extensions 12'' of domes 12' resist inversion under normal loading while domes 12' invert under normal loading. For a more detailed disclosure of the snap-action tactile elements 12 with the non-invertible actuator elements 12'', reference is hereby made to United States patent application Ser. No. 961,628 assigned to Rogers Corporation, the assignee of this invention.

The conductive paths 11' on sheet 11 may cover all or a portion of the surface of element 12 which face sheet 13. When a reverse dome 12' is inverted, in the manner to be described below, the wall thereof flexes and moves through an aperture 15' in sheet 15 and electrical contact is thus established between an individual "row" conductor 11' on sheet 11 and a "column" conductor 14 on sheet 13. Conductors 14 are shown in parallel columns only for purposes of illustration; however, as will be understood by those skilled in the art, the columns 14 on sheet 13 may be arranged in any desired circuit pattern depending on the function to be performed.

Keyboard 10 of FIGS. 4 and 5 further includes a flexible legend sheet 16 having a plurality of concave depressions 17 therein. Depressions 17 are integral with sheet 16 and allow the user of keyboard 10 to perceive the location of associated keys by touch. Depressions 17 are thus aligned with tactile snap-action elements 12. When sheet 16 is urged downwardly, e.g. by force from a finger or other actuator inserted in a depression 17, the dome 12′ aligned with the depression inverts causing a circuit to be completed between circuitry on sheets 11 and 13 whereby an information bearing electrical signal is generated. In addition to being perceptible by touch, depressions 17 may have a legend printed therein or adjacent thereto to provide visual indications of the area to be pressed by the person using the keyboard. Legend sheet 16 is spaced from sheet 13 by a sheet of resilient foam material 18 including a plurality of apertures 19 shaped and spaced to receive depressions 17. Sheet 18 is preferably made from a foam material of the type having low compression set. By low compression set, it is meant that after repeated compression and expansion, the material essentially maintains its dimensions. An example of such material is PORON foam obtainable from Rogers Corporation, the assignee of this invention. Legend sheet 16 may be adhered to foam sheet 18 by a conventional adhesive. Once keyboard 10 is formed, the keyboard is placed on a base 20. Base 20 may, for example, represent a surface of a cash register with which the keyboard may be used; or base 20 may be an integral part of the keyboard 10 and may be sold with the keyboard. Keyboard 10 of FIGS. 4 and 5 may additionally include a spacer member, which may comprise a second low compression set foam sheet 18′ positioned between sheet 11 and base 20. The spacer member 18′ will include a plurality of apertures 19′ adapted to receive tactile snap-action elements 12. Spacer member 18′ will have a thickness approximately equal to the combined height of domes 12′ and actuator elements 12″; and the flat end caps of actuator elements 12″ contact base 20.

The operation of keyboard 10 of FIGS. 4 and 5 will now be described. A person using the keyboard places his finger in a depression 17 and presses downwardly. The underside of the depression 17 contacts sheet 13 and flexes sheet 13 downwardly against sheet 11 to impose a load on the associated snap-action element 12 downwardly toward base 20. This load on the snap-action element 12 causes a reaction between the end cap of the actuator 12″ (because essentially no downward motion of the end cap of actuator 12″ is possible). This force causes dome portion 12″ of element 12 to snap to the inverted condition whereupon the circuitry 11′ makes electrical contact with the circuitry 14 on sheet 13. The first sheet 18 of resilient foam material compresses in the region of the depression 17 and the spacer 18′ may compress slightly in the region of the element that is being inverted. When finger pressure on the depression 17 is released, the above described components return to their original position and contact is broken between circuitry 11′ and circuitry 14.

Figure 6:
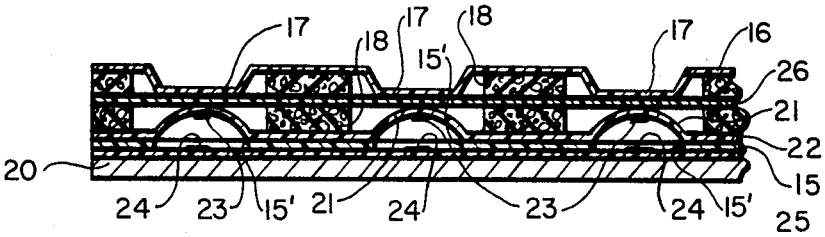
FIG. 6 shows a cross-sectional view of a keyboard in accordance with another embodiment of the present invention.

Referring to FIG. 6 another embodiment of the present invention is shown. The flexible legend sheet 16, including a plurality of depressions 17, may be used with dome shaped snap-action elements 21, the elements being of the type which are hemispherically shaped and which protrude upwardly toward the face of the keyboard. Dome elements 21 are integral with sheet 22 and include printed circuitry 23 on one surface thereof. When dome elements 21 are inverted, printed circuitry 23 contacts printed circuitry 24 on a second sheet 25. A spacer sheet 15 of insulating material isolates printed circuitry 23 from printed circuitry 24 except in the region of apertures 15′. Sheet 15 is as was previously described with respect to FIGS. 1 and 2. In the embodiment shown in FIG. 6, depressions 17 act indirectly on dome elements 21 via a flexible intermediate flat plastic sheet 26. Legend sheet 16 is maintained in position with respect to sheet 26 by an apertured sheet of resilient foam material 18 of the type previously described. Sheet 26 is spaced from the body or base plane of sheet 22 by a second apertured sheet of resilient foam material 18′ having apertures shaped to receive domes 21. In order to actuate a key, one of the depressions 17 is urged downwardly and dome 21 is inverted with a snap-action to thereby connect printed circuits 23 and 24. During inversion of dome 21, foam sheets 18 deform but provide sufficient rigidity to allow actuation of one key without the adjacent keys being actuated.

Figure 7:
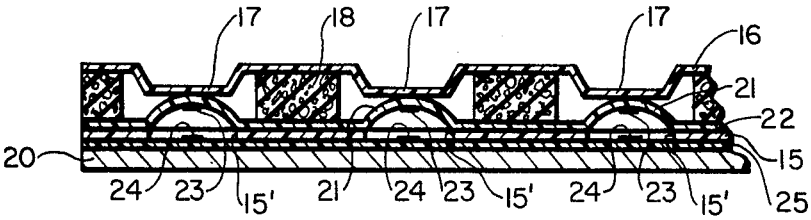
FIG. 7 shows a cross-sectional view of a keyboard in accordance with another embodiment of the present invention.

FIG. 7 shows another embodiment of the present invention wherein intermediate sheet 26 has been omitted and depressions 17 act directly on dome elements 21. Sheet 18 of foam material has a sufficient width to span the distance between the planar surface of legend sheet 16 in the areas intermediate the depressions and the base of sheet 22; that is, the thickness of foam sheet 18 is approximately equal to the combined depth of depressions 17 and the height of domes 21. The second resilient sheet 18′ is omitted from the FIG. 7 configuration.

In the keyboards shown in FIGS. 6 and 7, the dome shaped snap-action elements 21 may be replaced by the snap-action elements 12 shown in FIGS. 1 and 5 and the dimensions of sheets 18 adjusted accordingly. Thus, it should be understood that various types of snap-action elements may be used in the keyboard of the present invention. The shape of tactile snap-action elements 12 (FIGS. 1 and 5) and 21 (FIGS. 6 and 7) are being shown by way of example.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A switch comprising:

first contact means, said first contact means including a first conductive element being movable between first and second positions;

second contact means, said second contact means including a second conductive element aligned with and out of contact with said first conductive element when said first conductive element is in the first position, and said first conductive element being in contact with said second conductive element when said first conductive element is in the second position; and flexible cover sheet means, said cover sheet means defining a planar surface having at least a first depression in alignment with and extending toward said contact means conductive elements and having a base portion, whereby flexing of the base portion of said depression toward said contact means will move at least one of said conductive elements toward the other and establish electrical contact between said first and second contact means conductive elements.

2. A switch as in claim 1 including:

a layer of resilient cellular material between at least part of said cover sheet means and said first contact means.

3. A switch as in claim 2 wherein:

said resilient cellular material is of low compression set.

4. A switch as in claim 1 wherein:

said first contact means includes a sheet of plastic material having at least one snap-action protrusion formed therein;

said first conductive element is adhered to the interior of said protrusion; and said base of said cover sheet depression is in physical contact with at least a part of said protrusion.

5. A switch as in claim 4 including:

a peripheral layer of resilient cellular material between said cover sheet means and said first contact means.

6. A switch as in claim 5 wherein:

said resilient cellular material is of low compression set.

7. In a keyboard device having:

an array of snap-action electrical circuit elements, said elements being movable between a first position and a second position to provide tactile feedback;

electrical circuit contact means associated with each snap-action element;

each of said snap-action elements being out of contact with said contact means when said element is in said first position and in contact with said associated contact means when said element is in said second position;

the improvement comprising:

flexible cover sheet means including a plurality of depressions, said depressions being integral with the flexible sheet means, said depressions being in alignment with said snap-action elements and movable toward said snap-action elements to move the elements between said first and second position to provide for electrical contact between said elements and said contact means and to provide tactile feedback.

8. In a keyboard according to claim 7, the improvement further including:

at least one layer of resilient cellular material between at least part of said cover sheet means and a portion of said array of snap acting elements said resilient cellular material being compressible when said depressions are moved toward said snap-action elements.

9. A keyboard as in claim 8 wherein:

said resilient cellular material is of low compression set.

10. A keyboard as in claim 7 wherein:

said array of snap-acting elements comprises a first sheet of flexible plastic material with a plurality of snappable protrusions therein and having conductive circuit elements extending into the protrusions;

said contact means comprises a second sheet of plastic material having conductive elements thereon; and each of said depressions has a base portion in physical contact with a portion of an aligned protrusion.

11. A keyboard as in claim 10 wherein:

said layer of resilient cellular material is a peripheral layer between the periphery of said cover sheet and the periphery of said first sheet of plastic material.

12. A keyboard as in claim 10 wherein:

said layer of resilient cellular material has a plurality of apertures for receiving each of said depressions of said cover sheet.

13. A keyboard as in claim 10 wherein:

said layer of resilient cellular material has a plurality of apertures, one of said protrusions and one of said depressions extending into and meeting in each of said apertures.

14. A keyboard as in claim 10 wherein:

each of said protrusions has a spherical portion and a cylindrical actuator portion; and wherein said base portion of each depression contacts said cylindrical actuator portion.

15. A keyboard as in claim 10 further including:

a separator sheet between said cover sheet and said first sheet of plastic material; and further including two layers of resilient cellular material, the first layer being between said cover sheet and said separator sheet, and the second layer being between said separator sheet and said first sheet of plastic material.

16. A keyboard as in claim 15, wherein:

each of said layers of resilient cellular material has a plurality of apertures;

each of said depressions extending into an aperture in the first layer of resilient material, and each of said protrusions extending into an aperture in the second layer of resilient material.

* * * * *